United States Patent [19]

Chalmers

[11] 3,977,098

[45] Aug. 31, 1976

[54] SKI BOOT LINER HAVING ADJUSTABLE WIDTH SIZING

[75] Inventor: Edward L. Chalmers, Boulder, Colo.

[73] Assignee: Garcia Corporation, Teaneck, N.J.

[22] Filed: Feb. 25, 1976

[21] Appl. No.: 661,031

[52] U.S. Cl. ..... 36/89; 36/136; 36/71

[51] Int. Cl.[2] ..... A43B 7/20; A43B 23/00; A43B 19/00

[58] Field of Search ..... 36/88, 89, 93, 117, 36/136, 71

[56] References Cited

UNITED STATES PATENTS 3,237,319 3/1966 Hanson ..... 36/71

3,584,622 6/1971 Domenico ..... 36/89

*Primary Examiner*—Patrick D. Lawson

*Attorney, Agent, or Firm*—Fitzpatrick, Cella, Harper & Scinto

[57] ABSTRACT

A liner for a molded athletic boot is formed with pockets on either side thereof in the area about the wearer's ankle. Each of the pockets has a slit-like opening for positioning one or more inserts therein to adjust the width size. Closure means are provided to close the slit-like openings of each pocket.

12 Claims, 4 Drawing Figures

SKI BOOT LINER HAVING ADJUSTABLE WIDTH SIZING

BACKGROUND OF THE INVENTION

The present invention relates to molded athletic boots and more particularly it concerns a novel liner for ski boots or hockey skates. Liners are needed in molded boots, since the outer shell is molded from a synthetic material which is semi-rigid, generally unyieldable and therefore uncomfortable, absent some form of internal lining. Moreover, in the case of ski boots, the advent of molded synthetic shells has permitted the utilization of a single sized shell for a range of foot sizes. Thus, the retailer could reduce his inventory of different size shells while fitting the same to various sized feet by using interchangeable liners. Nevertheless, under this procedure the retailer still needed a rather large inventory of different sized liners. Thus, it is of economic significance to also provide a standard, single size liner which can be modified to fit a range of foot sizes.

Several types of boot linings are known for use in molded athletic boots, some of which are designated to accommodate different foot sizes.

In one construction, illustrated in U.S. Pat. No. 3,325,920, the boot shell is formed with internal envelopes which can be filled with a flowable material. However, in order to fit the boot to a wearer's foot, a special machine is needed to insert the filler material.

In a further arrangement, as described in U.S. Pat. No. 3,237,319 a pad containing a flowable material is positioned within a boot about the ankle and back of a wearer's foot. In this arrangement, however, no means are provided for adjusting a single size boot to accomodate various sized feet. That is, once the boot is manufactured with a particular width size, further adjustment thereof is not possible by the retailer or consumer.

In another arrangement, individual pockets of flowable material are removeably positioned within the molded outer shell. As shown in U.S. Pat. Nos. 3,374,561 and 3,407,406 these pockets are designed to permit insertion of additional pillows of the flowable cushioning material. It will be apparent, however, that in order to obtain a proper fit, the pockets must be randomly adjusted by adding or removing pillows. Moreover, due to the compressability of the material, adjustment thereof can only be accomplished by extensive trial and error.

In yet another arrangement, a separate liner is inserted into a molded outer shell. To adjust the fit, shims are glued to either the outside or the inside surface of the liner as shown in U.S. Pat. No. 3,858,337. However, these shims can easily peel off either during use or while inserting or removing the liner from a molded outer shell. Additionally, shims which are glued to the surface of a liner are unattractive and therefore difficult to market.

SUMMARY OF THE INVENTION

The present invention avoids the disadvantages of the prior art by means of a novel liner or inner boot for a molded outer shell which contains lateral pockets for retaining one or more inserts which permit width adjustment of the liner without having to rely on trial and error methods and without the need for special equipment. Thus, with the instant invention, dealers can maintain a smaller inventory of boots and boot liners and yet provide a full range of boot sizes. In addition, consumers can readily make simple width adjustments after buying the boots should a different fit be desired after use, such adjustments being a common occurrence particularly with ski boots.

According to one aspect of the present invention there is provided in an athletic boot having a semi-rigid outer shell, a novel liner comprising a pair of side panels which together substantially encase the foot and ankle of a wearer. Each panel includes a side pocket for housing inserts of predetermined configuration. The pockets are accessable through slits cut in the outer wall, and means are provided to cover and close the slit-like openings.

The liner is preferably manufactured to fit a wide foot when a layer of cushioning material is placed in each pocket. Additional padding may be inserted into the pockets to adapt the liner to fit a medium or a narrow foot. Therefore, one liner may be used for a range of foot sizes.

There has thus been outlined the more important features of the invention in order that the detailed description that follows may be better understood and in order that the present contribution to the art may be better appreciated. There are, of course, additional features of the invention that will be described hereinafter and which will form the subject of the claims appended hereto. Those skilled in the art will appreciate that this invention may be utilized as a basis for designing other structures for carrying out the several purposes of this invention. It is therefor important that the claims be regarded as including such equivalent constructions as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein:

FIG. 3 is a cross-sectional view of the liner of the invention with cushioning material positioned in the pockets of the liner.

DETAILED DESCRIPTION OF THE PREFERRED EMBODIMENT

Figure 1:
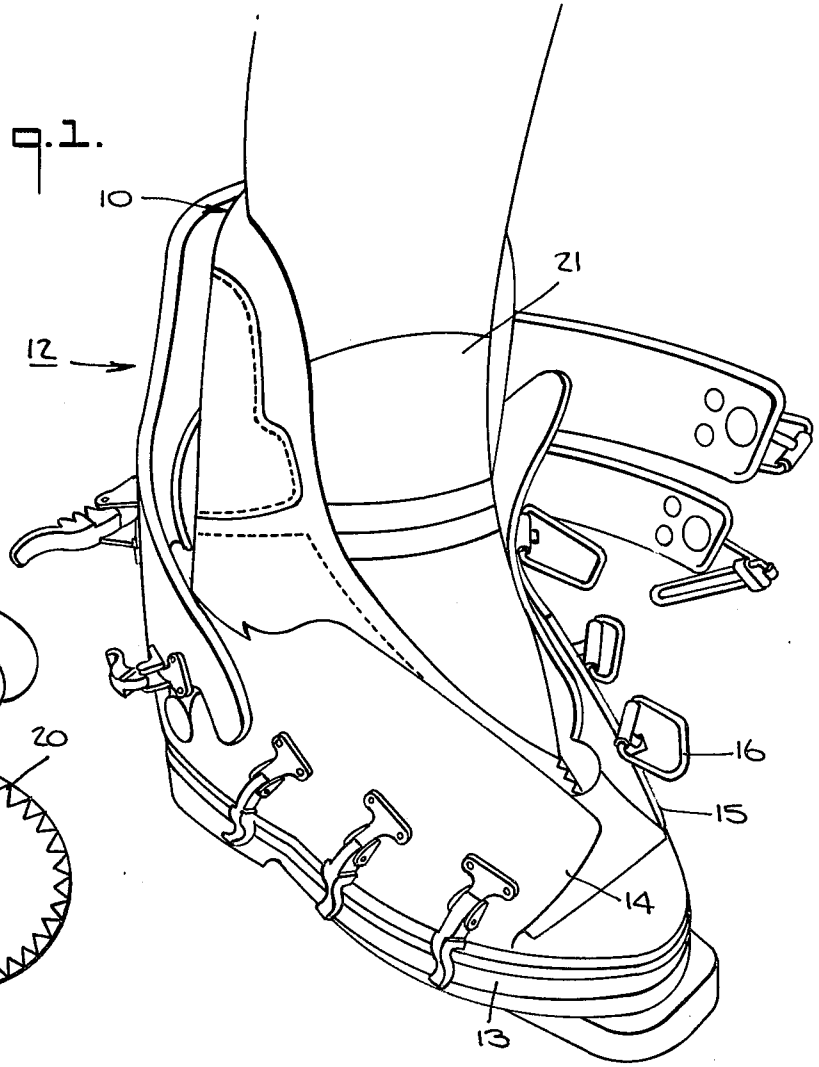
FIG. 1 is a perspective view of a molded athletic boot, partially cut away, containing a liner embodying the present invention.

The inner boot or liner 10 of the present invention is particularly useful in association with a synthetic, molded ski boot such as shown in FIG. 1 and generally indicated by the numeral 12. The ski boot comprises a shell 13 of the front entry type having a pair of closure flaps 14, 15. A plurality of buckles 16 are located along the closure flaps 14, 15 for closing and locking the shell about the inner boot or liner 10 once the boot has been put on. It should be understood that the configuration of the boot shell forms no part of the present invention and the foregoing description is illustrative only. Moreover, as will be clearly apparent from the following description, the liner of this invention, although described in conjunction with a front entry boot is equally adaptable to other types of boots such as a rear entry boot with only minor modification.

Figure 2:
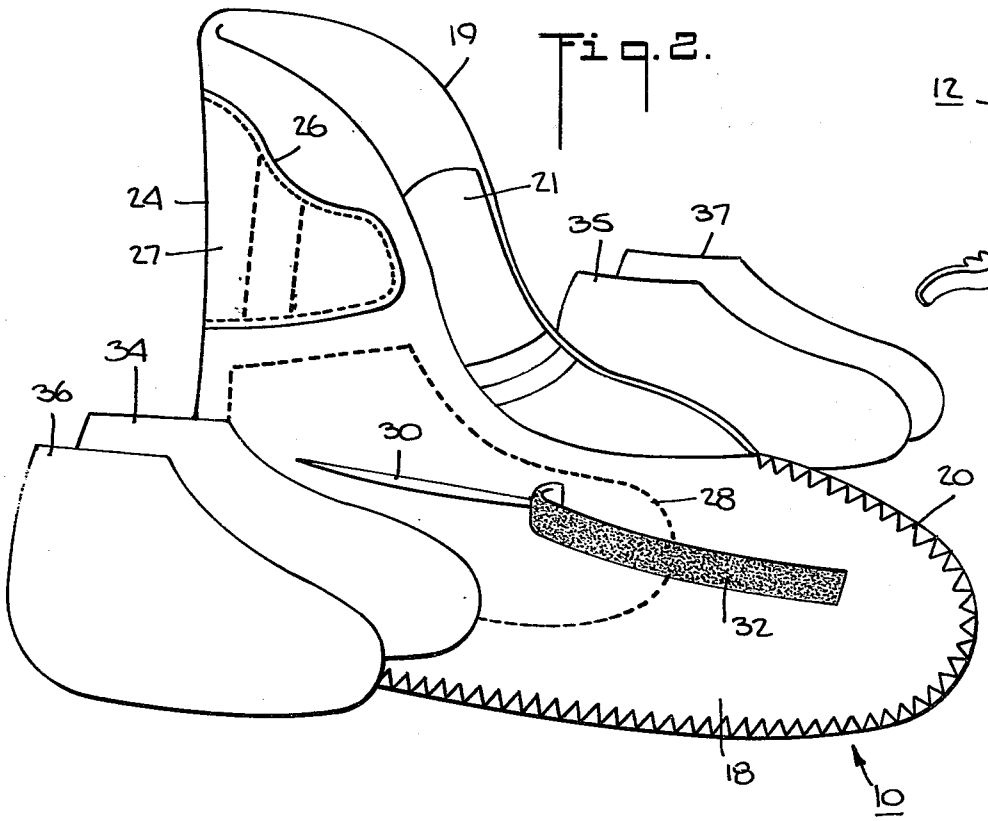
FIG. 2 is a perspective view of the liner of the invention illustrating, in exploded form, a plurality of inserts therefore.

With reference to FIG. 2, the liner 10 of the instant invention is shaped to substantially encase the foot, ankle and, to a limited extent, the lower calf of a wearer's foot, and as such resembles a sock or boot. The liner is formed from a blank defining a pair of side panels 18, 19, having a common area which forms the back. The blank is folded and secured such as by stitching 20, along the bottom and toe regions and finally a tongue 21 is secured at the toe region to complete the form. It will be apparent that each side panel 18, 19 is substantially a mirror image of its opposite counterpart; and accordingly, only one side will be described hereinafter for simplicity sake.

Side panel 18, is formed from inner and outer fabric layers 22, 23, respectively, preferably of looped tricot nylon, which are stitched together about their outer edges. While these layers provide some padding between the wearer's foot and the outer shell 13, additional padding of polyurethane, foam rubber or cotton batting (not shown) may be provided between the fabric layers. For example, in molded ski boots for advanced skiers, the back of the boot shell is provided with a spoiler which angles in a forward direction to bear on the calf of a wearer. To cushion against the resulting pressure, the region 24, defined by stitching 26, may be provided with additional padding and with a scuff resistant outer layer 27 of leather or similar material.

The side panel 18, also includes a pocket 28, defined by stitching fabric layers 22, 23 together, in the ankle region. As shown, the pocket 28 is preferable of L-shaped configuration. Thus, when the liner 10 is placed within the boot shell 13 the pocket 28 is positioned substantially adjacent the ankle and the side of the wearer's foot. The pocket 28 is provided with a slit-like exterior opening 30, cut in the outer layer 23, to permit various inserts to be positioned therein. A removable strip of material 32, is provided to cover the slit-like opening 30. This strip may be of any material which will effectively cover the slit 30 and remain in place during use of the boot. However, to provide a reusable closure arrangement, it is most advantageous to use a strip 32 made from a hook type closure material such as that sold under the trademark VELCRO. In this regard, as stated hereinabove, the fabric of the liner is preferably a looped nylon tricot which provides the necessary coacting surface for the hooks or bristles of the VELCRO strip 32. With such an arrangement, a slight pulling force perpendicular to the outer fabric layer will separate the strip from the liner, however, no separation results when forces are applied in the plane of the outer fabric layer. Thus minor shifting of the liner within the shell will not cause separation of the closure arrangement. It will also be appreciated that while it is preferred, for ease of manufacture, to construct the entire side panel 18 from looped nylon tricot, only the area immediately adjacent slit 30 need be of a raised looped fabric to provide the needed gripping surface for VELCRO strip 32.

As best shown in FIG. 3, the pocket 28, is preferably provided with an insert of padding material 34, in an amount sufficient to provide adequate cushioning for a wearer's ankle. This padding, which is pre-cut from any conventional material to correspond to the dimensions of pocket 28, is preferably factory installed, but may also be installed by the retailer.

As stated previously, side panel 19 is identical to panel 18 and thus includes a pocket 29 in which cushioning material 35 may be positioned.

In order for liner 10 to accommodate several width sizes, the liner width 'A' must be kept the same irrespective of the wearer's width size. Therefore, additional inserts 36, 37 are provided to fit within pockets 28, 29. These inserts are dimensioned to correspond to the configuration of the pockets and are of a relatively incompressible material such as felt.

Figure 4:
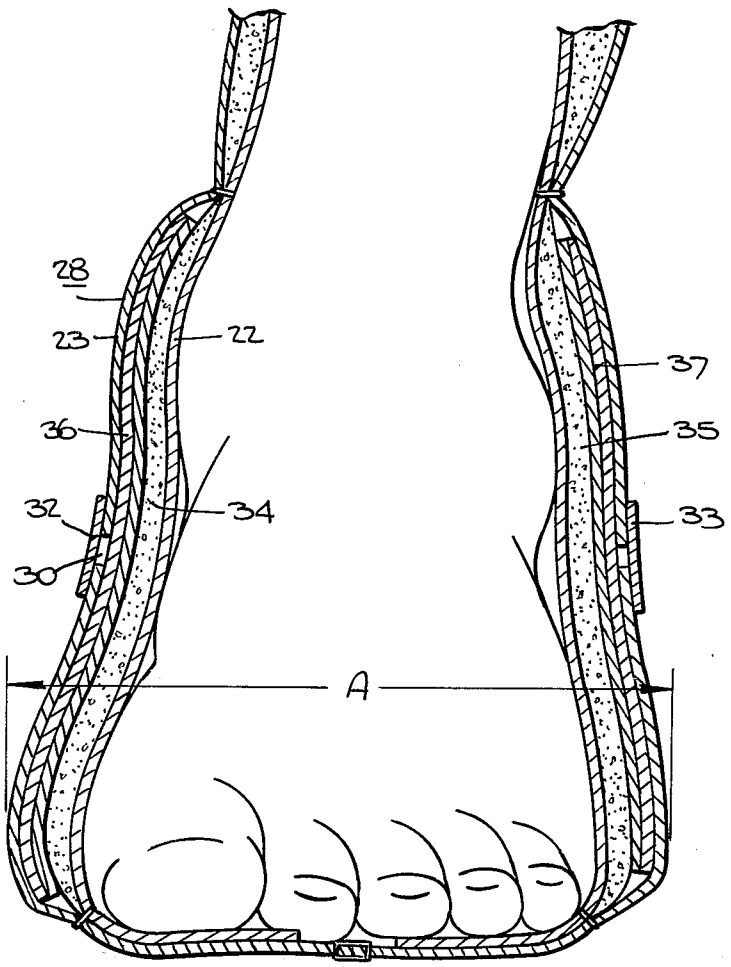
FIG. 4 is a view, similar to FIG. 3, but wherein two relatively incompressible inserts, together with a layer of cushioning material, are positioned within each pocket.
Figure 5:
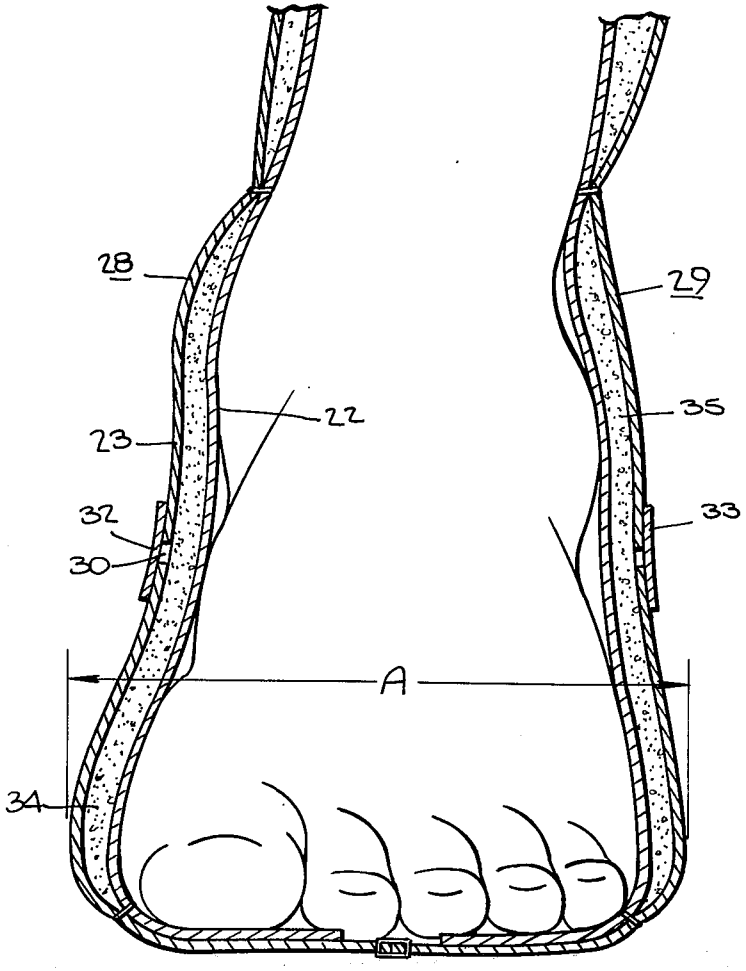

In such manner liner 10 is manufactured to fit a wide foot when only a layer of cushioning material 34, 35 is positioned in pockets 28, 29. The liner may then be used with a single size boot by adjusting the liner to fit a range of width sizes. The liner is adjusted to fit a medium or narrow foot by opening the closure strips 32, 33 and positioning one or more inserts 36, 37 within pockets 28, 29. As clearly shown in FIGS. 3 and 4 the width 'A' of the liner remains constant whether a wide or narrow foot is positioned in liner 10. If the inserts are felt fabric having a thickness of 0.05 inches, a single incompressible insert in each pocket will adapt the liner to fit a medium foot while a pair of inserts in each pocket will adapt the liner to fit a narrow foot. After repositioning closure strips 32, 33, the liner is ready for use. It will, therefore, be appreciated that the liner construction of the present invention avoids guesswork during fitting as well as the need for complicated forming machines or the like. Also, should the wearer later wish to alter the width sizing, inserts may be easily added or removed.

While the liner of the instant application has been described to include separate inserts for cushioning and for width sizing, it is also within the scope of the invention to use inserts which cushion and simultaneously vary the width adjustment due to the thickness of the cushioning layer.

What is claimed is:

1. A liner for an athletic boot having a semi-rigid outer shell, said liner comprising a pair of side panels which together substantially encase the foot and ankle of a wearer, pockets formed in each of said side panels along the ankle region of said liner, each pocket having a slit-like opening for positioning one or more inserts therein, and closure means to cover the associated slit-like opening, whereby the width sizing of said liner is adjusted by adding or removing inserts to or from said pockets.

2. A liner for an athletic boot according to claim 1, wherein said closure means is a pull-apart closure means.

3. A liner for an athletic boot according to claim 2, wherein said liner is made from a looped tricot nylon and said closure means is a strip of material having bristles.

4. A liner for an athletic boot according to claim 2, wherein each panel includes inner and outer fabric layers, each slit-like opening being formed in an outer fabric layer, wherein the outer layers are made from looped tricot nylon and wherein said closure means are strips of material having bristles.

5. A liner for an athletic boot according to claim 1, further including at least one insert positioned in each pocket for adjusting the width sizing of said liner.

6. A liner for an athletic boot according to claim 1, further including an insert of cushioning material within each pocket.

7. A liner for an athletic boot according to claim 6, further including at least one additional insert in each pocket for adjusting the width sizing of said liner.

8. A liner for an athletic boot according to claim 7, wherein said additional inserts are made from an incompressible material.

9. A liner for an athletic boot according to claim 8, wherein said additional inserts are of a felt-like material.

10. A liner for an athletic boot according to claim 8, wherein said additional inserts are 0.05 inches thick.

11. An athletic boot comprising a semi-rigid outer shell and a liner positioned within said outer shell, said liner including a pair of side panels which together substantially encase the foot and ankle of a wearer to thereby protect the wearer from the adjacent outer shell, pockets formed in each of said side panel along the ankle region of said liner, each pocket having a slit-like opening for positioning one or more inserts therein and closure means to cover the associated slit-like opening, whereby the width sizing of the liner is adjusted by adding or removing inserts to or from said pockets.

12. An athletic boot according to claim 11, further including at least one insert positioned in each pocket of said liner for adjusting the width sizing of said liner.

* * * * *